United States Patent [19]

Haas et al.

[11] Patent Number: 4,950,136

[45] Date of Patent: Aug. 21, 1990

[54] PERISTALTIC PUMP

[75] Inventors: Richard E. Haas, Fairfax; Thomas R. Fegette, Batavia, both of Ohio

[73] Assignee: Hydro Systems Company, Cincinnati, Ohio

[21] Appl. No.: 393,899

[22] Filed: Aug. 14, 1989

[51] Int. Cl.[5] ..... F04B 43/12

[52] U.S. Cl. ..... 417/477; 604/153

[58] Field of Search ..... 417/474–477; 604/153; 128/DIG. 12

[56] References Cited

U.S. PATENT DOCUMENTS

| | | | |
|---|---|---|---|
| 2,694,984 | 11/1954 | Daniels . | |
| 2,804,023 | 8/1957 | Lee . | |
| 2,885,966 | 5/1959 | Ford | 417/477 |
| 2,909,125 | 10/1959 | Daniels . | |
| 2,935,028 | 5/1960 | Ferrari, Jr., et al. . | |
| 2,955,543 | 10/1960 | Daniels . | |
| 3,101,675 | 8/1963 | Isreeli . | |
| 3,116,697 | 1/1964 | Bilichniansky . | |
| 3,137,240 | 6/1964 | Hunt | 417/477 |
| 3,137,242 | 6/1964 | Hahn . | |
| 3,192,863 | 7/1965 | Vadot . | |
| 3,507,585 | 4/1970 | Mercer . | |
| 3,597,123 | 8/1971 | Lutz . | |
| 3,644,068 | 2/1972 | Lepak . | |
| 3,737,256 | 6/1973 | DeVries . | |
| 3,822,948 | 7/1974 | Handl . | |
| 3,829,251 | 8/1974 | Schwing . | |
| 3,927,955 | 12/1975 | Spinosa et al. . | |
| 3,960,466 | 6/1976 | Taylor . | |
| 3,963,023 | 6/1976 | Hankinson . | |
| 3,990,444 | 11/1976 | Vial . | |
| 4,108,575 | 8/1978 | Schal . | |
| 4,155,362 | 5/1979 | Jess . | |
| 4,185,948 | 1/1980 | Maquire | 417/477 |
| 4,210,138 | 7/1980 | Jess . | |
| 4,217,062 | 8/1980 | Trp et al. . | |
| 4,278,085 | 7/1981 | Shim . | |
| 4,363,609 | 12/1982 | Cosentino et al. . | |
| 4,417,856 | 11/1983 | Minissian . | |
| 4,487,558 | 12/1984 | Troutner . | |
| 4,545,744 | 10/1985 | Weber et al. | 417/477 X |
| 4,548,553 | 10/1985 | Ferster | 417/477 |
| 4,558,996 | 12/1985 | Becker . | |
| 4,564,342 | 1/1986 | Weber et al. . | |
| 4,573,884 | 3/1986 | Troutner . | |
| 4,586,882 | 5/1986 | Tseng . | |
| 4,606,710 | 8/1986 | Maguire . | |
| 4,705,464 | 11/1987 | Arimond | 417/477 |
| 4,886,431 | 12/1989 | Soderquist et al. | 417/477 |

FOREIGN PATENT DOCUMENTS

| | | | |
|---|---|---|---|
| 59-074387 | 4/1984 | Japan | 417/477 |
| 1244377 | 7/1986 | U.S.S.R. | 417/477 |

*Primary Examiner*—Leonard E. Smith
*Assistant Examiner*—Eugene L. Szczecina, Jr.
*Attorney, Agent, or Firm*—Wood, Herron & Evans

[57] ABSTRACT

A peristaltic pump includes rotor-mounted rollers biased apart and having end steps for engaging corresponding cam surfaces on the pump body and cover to direct non-pumping rollers in a predetermined path and maintain a constant tube engaging pressure on the pumping rollers. Radial pumping loads are transmitted through the rollers and biasing springs to the cam surfaces via rolling contact rather than to the rotor and its drive shaft. Drive shaft bearings are eliminated. The diameter of the end steps is different and preferably less than that of the tube engaging roller surface. Rollers having varying end steps are provided to accommodate different pumping tubes, desired spring pre-loads and the like.

18 Claims, 1 Drawing Sheet

PERISTALTIC PUMP

This invention relates to peristaltic pumps and more particularly to improvements in peristaltic pumping apparatus.

Peristaltic pumps are generally based on the concept of a series of progressive occlusions of a flexible or compressible tube. One occlusion forces a pumped liquid through a compressible section of tube with a following occlusion maintaining pressure on the pumped fluid, and so on.

In a typical peristaltic pump, a compressible tube is oriented in a horseshoe-like bend and the curved portion supported on its outer side against a curved stationary surface such as the interior wall of a cylinder. Ends of the tube extend outwardly so the pumping section of the tube is frequently in a "U" shape, although other tube configurations are used.

A rotor-mounted roller engages and progressively squeezes the tube against the surface to occlude its internal passage. This occlusion is carried around the curved support surface by the roller until the roller approaches the downstream outlet portion of the tube, which diverges from the roller's path, and is carried away from tube engagement by its continued circular motion. Prior to tube disengagement, however, another roller engages the tube at an upstream position to again occlude it and continue pumping action. Accordingly, rollers alternately engage, compress and disengage the tubing, thus forcing fluid in the tube ahead of the rollers downstream along the tubing.

A plurality of offsetting parameters must be considered in the design of such pumps. For example, the rollers are typically carried on a rotor supported on a drive shaft for circulating the rollers. Tube occlusion exerts a radial load on the rollers by virtue of the resistance of the tube to compression, fluid viscosity, pumping pressure and the like. This load is transmitted to the rotor drive shaft as an unbalanced radial load through the rotor. Such load is generally unbalanced since no load is exerted on the off-side rollers when they are not in pumping contact with the tube. Adequate bearings are thus required for the drive to rotatably support the load.

At the same time, tolerances are critical since it is desirable to squeeze the tube only enough to provide the desired pumping pressure. Extensive compression of the tube walls tends to unduly and prematurely fatigue and damage the tube, requiring more frequent replacement.

In the past, spring-loaded roller devices have been proposed for use in these pumps. In one such device the roller carrying rotor is slotted, and the roller shafts fit in these slots. Springs are oriented between the shaft ends of opposing rollers. In use, when the rotor is oriented so that only one roller engages the tubing to compress it, the occlusion load is resisted by the spring supported by the shaft of the off-side roller. This shaft is thus biased against the outer end of the rotor slot and the radial load is thus transmitted to the rotor drive shaft through the spring, off-side roller shaft, and rotor. The drive shaft is thus significantly loaded and adequate bearing means are still required to rotatably carry this load. While this configuration provides certain advantages such as the use of a spring to bias the roller into occluding engagement with the tube, radial loads are still presented to the rotor drive and bearing concerns such as wear and motor torque requirements exist.

Moreover, once the leading or off-side roller disengages the tube, additional movement of that roller shaft outwardly to the slot end decreases spring bias exerted on the opposite pumping roller. This pre-load variation causes variations in pumping performance.

In yet another prior approach, such as disclosed in U.S. Pat. No. 4,606,710, the roller surfaces extend laterally beyond the tube into engagement with a guide surface on the housing supporting the rollers throughout their circular path and during occlusion contact with the tube. This configuration relieves radial load on the rotor and drive shaft, but still requires very close and expensive to produce tolerances between and within the tube support surface, the guide surface and the tube itself in order to provide correct occlusion without excessively compressing the tube and shortening its useful life.

Accordingly, it has been one objective of the present invention to provide an improved, inexpensive peristaltic pump wherein roller pressure on the pump tubing is positively controlled and balanced throughout its pumping cycle.

A further objective of the invention has been to provide an improved peristaltic pump accommodating varying sizes of pump tubing.

A further objective of the invention has been to provide a peristaltic pump having no rotor shaft bearings, and spring loaded, rotor mounted pumping rollers, wherein the pump can accommodate varying tube sizes.

A further objective has been to provide an improved peristaltic pump of inexpensive manufacture where adjacent movable portions of the roller supporting rotor and the pump housing are in sliding contact with no bearings being required.

A still further objective of the invention has been to provide a peristaltic pump with improved pumping rollers for accommodating pumping tubes of varying sizes and materials.

A yet further objective of the invention has been to provide a peristaltic pump with improved pumping rollers and roller control means to enhance pump performance and service life.

To these ends, a preferred embodiment of the invention includes a peristaltic pump having a rotor and rollers mounted in shafts disposed in slots on the rotor, with springs extending between the roller shafts. Each roller has an end step of a predetermined diameter, preferably smaller than the roller tube engaging surface, for engaging lateral guide or cam surfaces disposed in the pump housing and cover in a path interfering with and guiding the end steps on the roller ends. The guide or cam surface determines the outward radial extent of movement of the rollers, particularly in their non-pumping, non-occluding or off-side positions with respect to the tubing.

Spring bias is predetermined and can be selected or varied for optimum pumping performance based on the actual tubing used. Various tube sizes and materials can be accommodated in the same pump by substituting rollers having different relationships between their end step and operating diameters, and by using springs which are appropriate to the specific tube and desired pumping pressure.

No bearings are necessary in the pump since the radial loads are borne primarily by the rollers, their end steps, the springs, and the guide surfaces, rather than by the rotor drive shaft. Very inexpensive plastic-to-plastic components can be used, and surface to surface tolerances are not as critical and can be accommodated by spring or roller step variations.

An inexpensive, yet effective, long wearing pump is thus provided.

These and other advantages and modifications will be more fully appreciated from the following written description of a preferred embodiment of the invention, and from the drawings in which.

Figures 1, 2, 3:
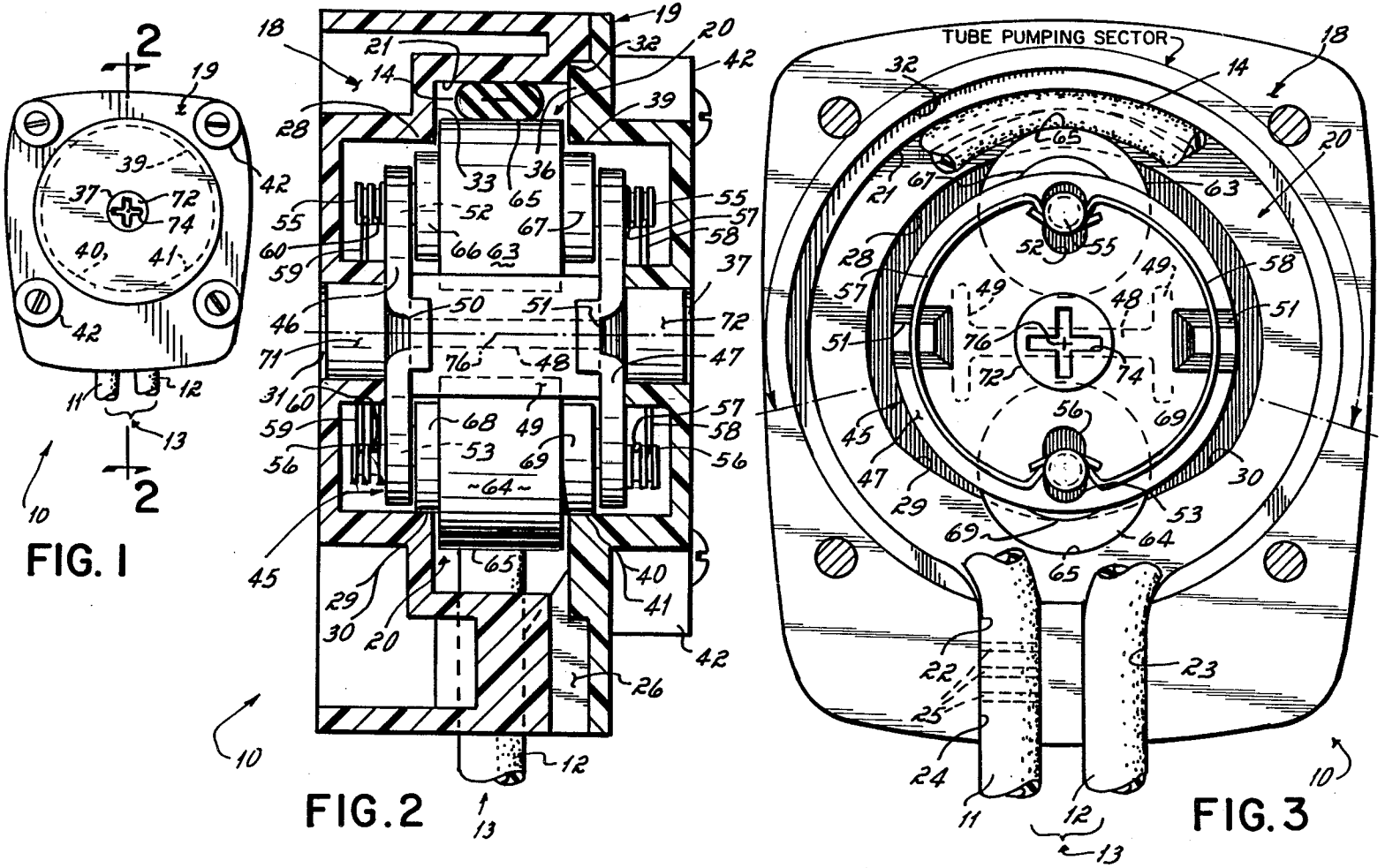
FIG. 1 is a front side elevational view of a peristaltic pump according to the invention.
FIG. 2 is a cross-sectional view taken along lines 2—2 of FIG. 1.
FIG. 3 is a view similar to FIG. 1 but having the cover of the pump removed and omitting a portion of the pump tube for clarity.

Turning now to the drawings, there is shown in FIG. 1 thereof a peristaltic pump 10 according to the invention. Pump 10 is operable to pump fluid from an inlet portion 11 to the outlet portion 12 of a compressible tube 13. Tube 13 is disposed in a somewhat curved or modified "U"-shaped configuration within the pump 10. The tube 13 includes a tube pumping portion 14 which extends throughout a tube pumping sector of the pump as indicated diagrammatically in FIG. 3. Depending on the configuration of the various components of the pump as will be described herein, the tube pumping sector may extend through a lesser or greater arc than shown and it will be appreciated that the arc shown in FIG. 3 is for diagrammatic purposes only.

In the pumping sector, the tube is compressed to a closed condition, such as that shown in FIG. 2, where the internal passageway of the tube is fully compressed and occluded as will be described.

Referring to FIG. 2, the pump 10 includes a pump housing comprising a pump body 18 and a pump cover 19 disposed on the body 18 to cover a cavity 20. The pump body 18 includes a curved tube support surface 21 for supporting an outer portion of the tube 13, at least throughout the tube pumping portion 14 in the tube pumping sector of the pump. The tube support surface is discontinuous. An aperture 22 is provided therein for accommodation of the inlet portion 11 of the tube 13 and an aperture 23 is provided therein for accommodation of the outlet portion 12 of the tube 13. A channel 24 disposed in the pump body 18 accommodates the inlet portion 11 of the tube beneath the cover 19. A plurality of projections 25 extend upwardly from the bottom of the channel 24 and tightly engage the tube when the cover 19 is screwed onto the pump body. This helps to prevent migration of the inlet portion of the tube upwardly and into the pump as the pump is operated. Outlet portion 12 of tube 13 extends away from cavity 20 through aperture 23 and another channel in the body. The cover 19 is provided with projections such as 26 to push and hold the tube in the respective body channels.

The pump body 18 is also provided with a surface 28 extending continuously around the pump body. This first guide means 28 includes angular cam portions 29 and 30 in a lower portion of the pump.

Rearwardly, the pump body includes an aperture 31 for receiving a drive shaft stub 71 of the pump rotor, all as will be described. Finally, it will be appreciated that the pump body 18 includes a shoulder 32 for receiving a portion of the cover 19 as will be described. Just beneath the shoulder 32 is a second shoulder 33 forming an annular stop for the tube 13.

The cover 19 includes a circular projection 36 extending into the body 18 for proper orientation of the cover with respect to the pump body. The cover is also provided with an aperture 37 for receiving another drive shaft stub 72 of the pump rotor as will be described. Also provided on the cover 19 is a second guide means comprising a surface 39 having angular cam portions 40 and 41 corresponding to and in register with the portions 29 and 30 of the pump body. These portions of the cover are also labelled in FIG. 1. The cover also includes mounting bosses, such as at 42, for receiving appropriate fasteners or screws to mount the cover 19 on the body 18 to form the pump housing.

The pump is also provided with a rotor 45. Rotor 45 includes two disc-like side members 46, 47 spaced apart by a web 48 extending between two integral flanges, one of which is shown in 49. The web 48 and the two integral flanges 49 form what would appear in a cross section to be a configuration similar to that of an I-beam. It will be appreciated that the width of the flanges 49 is such that the disc like side 46 and 47 extend outwardly thereof and outwardly of the web 48. Each of the disc like side members 46, 47 include inward protrusions such as at 50, 51 for guiding or centering the tube between the sides of the rotor.

The disc-like side members 46, 47 are provided with apertures such as at 52, 53. The apertures 53 are aligned with each other and the apertures 52 are aligned with each other. Roller shafts 55, 56 are disposed in the aligned apertures, roller shaft 55 being disposed in apertures 52, and roller shaft 56 disposed through apertures 53. Each of the shafts 55, 56 extend outwardly beyond the side members 46, 47 of the rotor, as best seen in FIG. 2. Moreover, each of the shaft ends are grooved as shown in FIG. 2.

Springs 57, 58 are disposed between the ends of the shafts 55, 56, adjacent the disc like side member 47 of the rotor. Spring members 59 and 60 are disposed between the ends of the shafts 55, 56 adjacent the disc like side member 46 of the rotor. Each of these springs 57 through 60 are wire springs having curved ends as shown, the curved ends being received in the respective slots or grooves in the ends of the shafts 55, 56. Constant force springs could be used advantageously as will be appreciated. It will be appreciated that when assembled to the shafts 55, 56, the springs exert an outward pressure thereon, biasing the shafts apart.

Rollers 63, 64 are mounted on the respective roller shafts 55, 56. Each of the rollers has a cylindrical tube engaging portion 65 thereon of predetermined diameter. Moreover, each of the rollers has a step down end portion at each end, such as at step down portions 66, 67 in roller 63 and step down portions 68, 69 in roller 64. It will be appreciated that the diameters of the step down ends 66, 67 and 68, 69 are preferably of a lesser dimension than the diameter of the tube engaging surface of portion 65 of each of the rollers, but could be larger than that of the tube engaging surface if desired.

Each of the disc-like side members 46, 47 is provided with a drive shaft stub 71, 72 integrally formed with the respective side members 46, 47. These drive shaft stubs 71, 72 extend through the apertures 31 and 37 in the pump body 18 and cover 19, respectively, in sliding engagement therewith. It will be appreciated that the pump body 18, the pump cover 19 and the rotor 45 are preferably made of a synthetic material such as an appropriate plastic or other epoxy or resinous material. There are no bearings between the drive shaft stub 71, 72 and their respective apertures 31, 37. Instead, the stubs merely slide on the internal aperture surfaces as the rotor is rotated. This sliding engagement is rendered possible by the fact that substantial radial loads are not transmitted to the drive stubs 71, 72 thus eliminating the need for bearings.

In this regard, it will be appreciated that the drive shaft stubs 71, 72 are provided with configured drive apertures 74 for receiving the drive shaft of a motor, or a drive extension from an adjacent mounted pump, for rotating the rotor 45 and thereby driving the respective rollers 63, 64 in a circular or clockwise direction, as viewed in FIG. 3.

It will be appreciated that when the rotor 45 is mounted within the pump body 18 and the cover 19 is applied thereto, the step down portion 66, 67 of roller 63 and the step down portion 68, 69 of roller 64 are in register with the respective guide means or cam surfaces 28, 39, respectively. It will also be appreciated that the tube engaging surfaces 6 of the respective rollers extend radially outwardly from surfaces 28, 39. Moreover, it will be appreciated that the guide surfaces 28, 39 are spaced radially inwardly from the tube support surface 21. The roller surfaces 65 engage and compress the tube in the pumping sector. Preferably, this engagement is under the bias of springs 57, 58 and the end steps of the tube engaging rollers are spaced from the guide means 28, 39 (see FIG. 3) such that the degree of tube compression is a function of tube parameters such as wall thickness, rigidity and the like, and of the preload exerted on springs 57, 58 by the non-pumping offside roller and its path defined by the guide means 28, 29 such as at 29, 30 and 40, 41. A constant force is preferably used to compress the tube independently of any precisely required and expensive tolerances. Accordingly, as the rotor 45 is rotated, the outward radial extension of the roller outside the tube pumping sector is controlled by these respective guide means or cam surfaces 28, 29, such that the outward extension of this roller is both limited and confined to a predetermined path. In this manner, a constant force can be exerted on the tube in the pumping sector through the springs without generating significant radial loads in the rotor itself.

Of course, and in another optional embodiment, the pump could be structured such that the roller end steps ride on the entire continuous guide means throughout the tube pumping sector. This embodiment could be used where the expense of precise tolerances is acceptable for a particular application.

In use, the preferred pump is assembled as shown in the figures and a prime mover, such as a motor, or a drive member extending from an adjacent pump is interconnected with one of the drive shaft stubs 71, 72 in order to rotate the rotor. As the rotor is rotated, the rollers 63, 64 respectively engage the collapsible or compressible tubing 13 and progressively compress it throughout the compressible or tube pumping portion 14 thereof. This progressive occlusion moves a segment of fluid within the tube along and downstream through the tubing. Once a leading roller such as roller 63, for example, clears the tubing at the bottom portion of the pump as viewed in FIG. 3, the following roller 64 has engaged the tubing so that this continued movement generates progressive compression chambers within the tubing and causes a pumping action to move fluid in the tubing therealong.

The tubing itself is selected according to the pumping parameters desired and the materials to be pumped. Preferably, the tubing is selected so that its size and flexibility characteristics permit the tubing to be occluded throughout the tube pumping sector without excess compression of the tubing wall such as would unduly shorten the life of the tubing. The relationship of the step down portions of the roller 63, 64 to the tube engaging surfaces of the rollers is related to the compressibility of the tubing in use so that uniform tube compression can be obtained. This variation of the step down ends of the rollers can be utilized for the purpose of permitting selection of a variation of the pumping tubes utilized for different pumping capacities or applications. The relationships between the step down portions of the roller surfaces, the tube sizes and the spring pre-load are all selected to provide the desired pumping performance, and a single pump can thus be easily and inexpensively modified as desired.

It will be appreciated that as the rotor 45 is rotated, the rollers 63, 64 sequentially engage the inlet portion 11 of the tube 13 and move around the tube, compressing it until the roller disengages therefrom just prior to another compression cycle. The rollers are urged against the tubing by means of the springs 57 through 60. The radial loading of the roller which is compressing tubing is transmitted through the springs to the shaft of the off-side or non-pumping roller (roller 64, FIG. 3) roller. If this shaft were allowed to engage the outer end of the respective slots 52 or 53, the compression force would be transmitted to the rotor and through the rotor to the drive shaft stubs 71, 72. The configuration of the guide means 28, 39, the pump body 18 and the pump cover 19, however, prevent this forced load transmission. Instead, the forces are thus transmitted from the tubing through one roller and the associated springs to the shaft of the opposed roller, and then through the opposing roller to the step-down portions thereof and the guide means which supports that roller. Accordingly, the radial pumping loads are substantially born by the pump housing, including the pump body 18 and cover 19, and not the rotor shafts 71, 72. Forces are transmitted through the rolling contact of pump rollers on guide means, rather than through sliding contact of rotor drive stub to aperture or journal. Accordingly, it is not necessary to provide any bearings between the drive shaft stubs and the apertures in the pump body or pump housing and the simple plastic-to-plastic sliding engagement is not so severely loaded that deterioration of the surfaces occurs. This eliminates any bearing expense in the pump.

It will also be appreciated that the guide means 28, 39 can be particularly configured as at 29, 30 in the pump body 18 and as 40, 41 in the cover 19, so as to sustain the desirable spring bias on the pumping roller.

Use of the spring bias and preload to control pumping also extends the tube life. It is not necessary to over compress the tube initially such that it wears prematurely. Instead, a pumping roller driven by an essentially constant force provides occlusion initially and throughout tube life without overcompression of a new tube and without loss of occlusion in a worn, but still serviceable, tube.

It will also be appreciated that the drive shaft stubs 71, 72 are flush with or slightly recessed in the pump 18 and cover 19, respectively. Accordingly, the pump can be used by itself in connection with a prime mover, or a series of the pumps can be ganged together utilizing only one prime mover, the pumps being interconnected by means of a drive shaft extending between the respective adjacent drive shaft stubs of the various pumps.

It will be appreciated that the pump has a pump axis 76 about which the rotor rotates and about which the rollers 63, 64 revolve in a path radially and outwardly spaced from the axis 76.

Also, it will be appreciated that while the guide means as described and shown are non-circular, such guide means could be circular while the support surface 21 was configured to provide the desired tube pumping sector and occlusion parameters desired. In addition, the guide means and the support surface 21 could each be circular, non-circular off-set or co-axial as desired to produce the desired tube compression.

Accordingly, the objectives of the inventions are met and applicant has provided a relatively inexpensive peristaltic pump utilizing roller control by means of the respective guide means and the end step roller portions to particularly control pumping operation and interaction of the rollers with the compressible tubing while at the same time eliminating pump bearings, accommodating varying sizes of pump tubes, varying pumping characteristics, and extending tube life as will be appreciated.

We claim:

1. A peristaltic pump including a pump housing, a pumping tube, a tube support surface, a plurality of rollers for serially engaging said tube, said rollers mounted for movement about a pump axis and having cylindrical tube engaging surfaces, and means for urging said rollers toward said tube to compress said tube against said surface as said rollers are moved therealong about said pump axis, the improvement including:

first and second guide means disposed in said housing;

cylindrical end steps on each of said rollers in register with respective first and second guide means, said end steps having a diameter less than that of said tube engaging surfaces;

said urging means comprising springs operably disposed between a pumping roller and a non-pumping roller; and said end steps of a non-pumping roller each engaging a respective guide means for controlling the radial displacement of said roller from said axis and the consequent spring force exerted on a pumping roller for compression of said tube as said rollers are driven about said axis.

2. The improvement of claim 1 further including a rotor means for carrying said rollers, said rotor means including two opposed sides, a central web extending between and integral with said sides, at least two sets of opposed slots disposed in said sides, the slots of each set in register with each other, and a roller shaft mounted in the slots of each set rotatably mounting said rollers to said rotor.

3. The improvement of claim 2 wherein said roller shafts extend outwardly of said rotor sides, and wherein said springs extend between the shaft ends proximate each side of said rotor for biasing the shafts and rollers thereon apart.

4. The improvement of claim 3 further including a drive shaft stub projecting outwardly from each said rotor side about a rotor axis parallel to said roller shafts.

5. The improvement of claim 4 wherein said pump housing includes an axially disposed apertures slidably receiving said drive shaft stubs.

6. The improvement of claim 5 wherein said pump housing and said drive shaft stubs are synthetic material, said drive shaft stubs in sliding engagement with said apertures.

7. The improvement of claim 5 wherein said pump housing includes a pump body in which one of said apertures and said first guide means is disposed, and a pump cover in which another of said apertures and said second guide means is disposed.

8. The improvement of claim 4 wherein each drive shaft stub includes a hollow drive member receiving aperture.

9. The improvement of claim 2 wherein said slots have outer ends and wherein said guide means prevent said shafts from engaging said outer slot ends.

10. The improvement of claim 1 wherein said pump housing comprises a pump body and a body cover, said first guide means disposed in said body and said second guide means disposed in said cover.

11. The improvement of claim 1 wherein said guide means are each disposed radially inwardly from said tube support surface and define respective non-circular cam surfaces.

12. The improvement of claim 11 wherein said cylindrical tube engaging surfaces of said roller extend radially outwardly beyond said guide means.

13. The improvement of claim 12 wherein said tube support surface is discontinuous and said respective guide means are continuous.

14. The improvement of claim 12 wherein said rollers alternately engage and compress said tube in a pumping sector thereof, a non-tube compressing roller responding to the control of said guide means to preload said springs to bias a tube engaging roller into compressing contact with said pumping sector of said tube.

15. The improvement of claim 1 wherein said springs are constant force springs.

16. A peristaltic pump including:

a pump housing;

a pump cover;

a compressible pump tube;

a tube supporting surface in one of said housing and cover;

a rotor having an axis of rotation;

at least two opposed rollers mounted on shafts extending through slots in said rotor radially spaced from said axis;

spring bias means extending between the respective ends of said roller shafts for biasing said rollers radially outwardly from said axis against said tube to compress said tube against said tube supporting surface for pumping fluid therein;

end steps on the opposite ends of each of said rollers;

first guide means on said housing;

second guide means on said cover;

said first and second guide means defining a path of traversal for said rollers; and the end steps on said rollers engaging said first and second guide means when said rollers are driven about said axis, said spring means biasing said roller end steps of one roller against said guide means and another opposed roller against said tube for pumping.

17. In a peristaltic pump having a pump axis and at least two opposed rotor mounted rollers within a pump housing for serially compressing a compressible tube, disposed in a curved configuration, against a tube support surface, apparatus for controlling the relative radial bias of a tube engaging roller against a tube, said apparatus comprising:

guide means disposed in said pump housing radially inwardly of said tube support surface;

spring means operably disposed between said opposed rollers biasing them radially outwardly;

end steps on each end of said rollers and of lesser diameter than that of a tube engaging surface of a respective roller, said end steps of one roller engaging said guide means and limiting movement of said one roller radially away from said pump axis and to a predetermined path such that a predetermined radial bias is maintained through the spring means on the opposed roller.

18. A pump as in claim 17 wherein tube engaging surfaces of said rollers extend radially outwardly of said guide means.

* * * * *